US005671678A

United States Patent [19]

Bolte et al.

[11] Patent Number: 5,671,678

[45] Date of Patent: Sep. 30, 1997

[54] LETTERPRESS PRINTING METHOD AND APPLICATOR DEVICE FOR ITS IMPLEMENTATION

[75] Inventors: George Bolte, Halle/Westf.; Lutz Nölle, Thannenbergstrasse 5, 7912 Weissenhorn; Franz-Josef Driller, Beerengrund 5, 4799 Borchen-Dörenhagen, all of Germany

[73] Assignees: Georg Bolte; Lutz Nolle; Franz-Josef Driller, all of, Germany

[21] Appl. No.: 541,090

[22] Filed: Oct. 11, 1995

Related U.S. Application Data

[63] Continuation of Ser. No. 976,497, Nov. 13, 1992, abandoned.

[30] Foreign Application Priority Data

Nov. 13, 1991 [DE] Germany ..... 41 37 337.5

[51] Int. Cl.[6] ..... B41F 31/00

[52] U.S. Cl. ..... 101/491; 156/277; 156/283; 156/322; 156/324; 156/325; 101/349

[58] Field of Search ..... 101/491, 487, 101/154, 155, 157, 161, 165, 167, 169, 170, 171, 211, 348, 349, 350; 156/61, 277, 283, 322, 324, 325

[56] References Cited

U.S. PATENT DOCUMENTS

| | | | |
|---|---|---|---|
| 3,950,650 | 4/1976 | Pray et al. | 101/491 |
| 4,007,682 | 2/1977 | Gundlach | 101/348 |
| 4,009,657 | 3/1977 | Bonanno et al. | 101/169 |
| 4,158,333 | 6/1979 | Navl | 101/169 |
| 4,301,583 | 11/1981 | Poole | 101/348 |
| 4,860,652 | 8/1989 | Kawata | 101/348 |
| 4,862,799 | 9/1989 | Hygner et al. | 101/348 |
| 4,939,994 | 7/1990 | Puleston | 101/348 |
| 4,964,336 | 10/1990 | Bock et al. | 101/349 |
| 5,093,180 | 3/1992 | Morgan | 101/348 |
| 5,233,921 | 8/1993 | John | 101/478 |

FOREIGN PATENT DOCUMENTS

| | | | |
|---|---|---|---|
| 0014663 | 1/1982 | Japan | 101/491 |
| 0059967 | 4/1982 | Japan | 101/491 |
| 0059968 | 4/1982 | Japan | 101/491 |
| 0152992 | 9/1982 | Japan | 101/491 |
| 0199886 | 11/1984 | Japan | 101/491 |

OTHER PUBLICATIONS

"Consolidated Offers the World's Largest Selection of Screens" Consolidated Engraver's 2 Page Brochure, Paper Converting Convention, Wash. D.C. Sep. 30, 1987.

*Primary Examiner*—Eugene H. Eickholt
*Attorney, Agent, or Firm*—Banner & Witcoff, Ltd.

[57] ABSTRACT

According to a method for applying binder systems, particularly printing ink, to web material using the letterpress printing process, a solvent-free binder system is applied to the letterpress form of an application roller by means of a pattern roller having a cell pattern with a cell depth of ≦15 μm. The applicator device has an impression cylinder and one or more application rollers, each of which is supplied with a binder system, preferably printing ink, via a binder application system equipped with a pattern roller, with the pattern roller having a cell pattern with a cell depth of ≦15 μm.

19 Claims, 7 Drawing Sheets

Fig. 2A
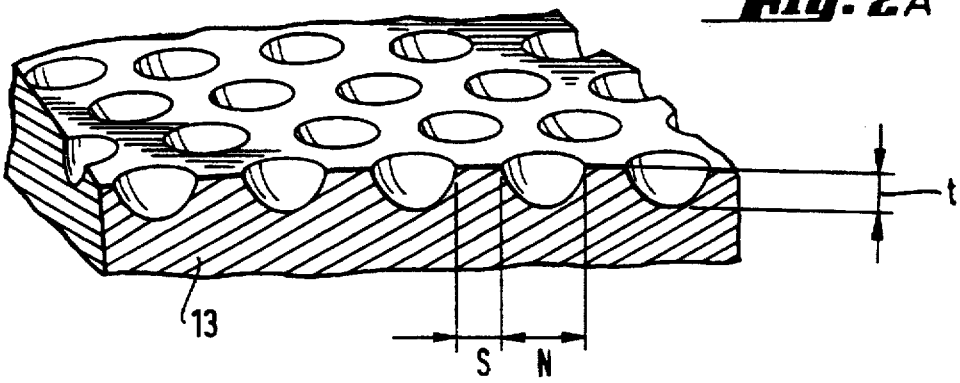
Fig. 2B
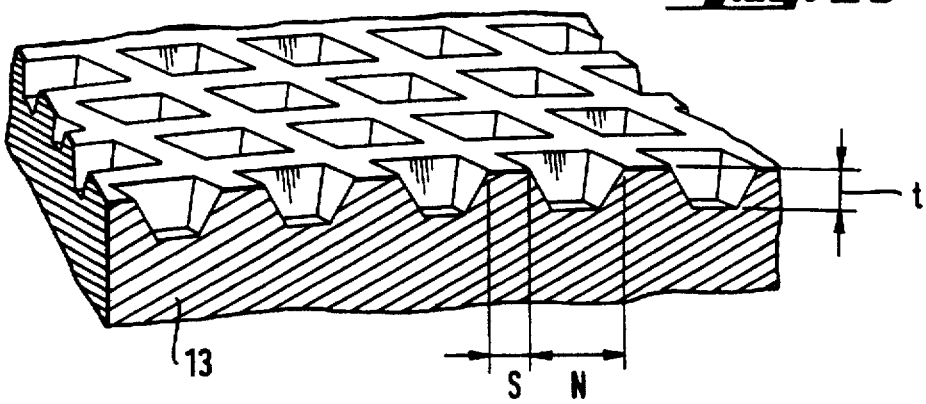
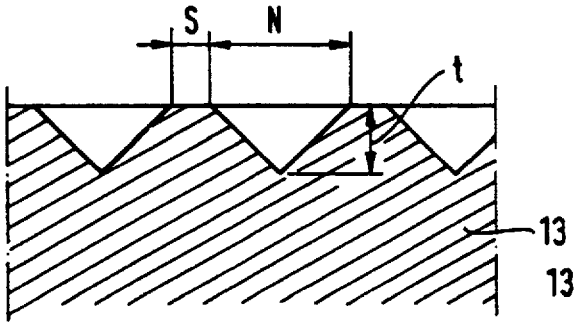
Fig. 2C
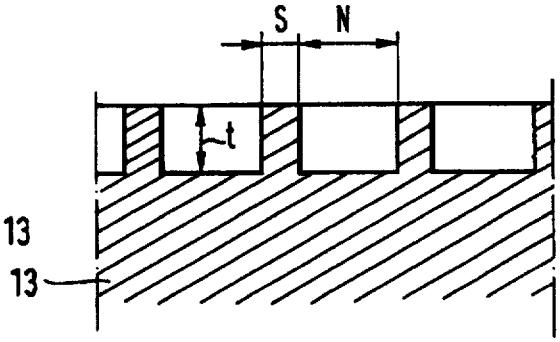
Fig. 2D

LETTERPRESS PRINTING METHOD AND APPLICATOR DEVICE FOR ITS IMPLEMENTATION

This is a continuation of application Ser. No. 07/976,497, filed on Nov. 13, 1992 now abandoned.

The printing of web-like material such as paper, synthetics and the like is carried out by means of an impression cylinder; the material is printed with a printing roller that is inked via an inking system. During letterpress printing, the printing block on the printing roller is provided with a raised design and, in the case of flexographic printing, the printing block consists of a synthetic material with elastomer properties. In letterpress printing, particularly in flexographic printing, solvent-containing printing inks having a solids content of approximately 30 wt. % and a solvent content of approximately 70 wt. % are used exclusively. In these processes, organic solvents and/or water are used as the solvent (diluting agent).

Surprisingly, it has now been discovered that letterpress printing can be carried out with solvent-free inks or binder systems (i.e. consisting entirely of solids) if a specially designed pattern roller is used for inking or coating the printing or application roller.

The object of the present invention is therefore a method for applying binder systems, particularly printing inks, to web material using the letterpress printing process, with the binder system being applied to the letterpress form of an application roller by means of a pattern roller, characterized by the fact that a solvent-free binder system is applied with a pattern roller having a cell pattern with a cell depth of $\leqq 15$ μm.

The object of the invention is also a printing device for implementing the above-mentioned method, having an impression cylinder and one or more application rollers, each of which is supplied with a binder system, particularly printing ink, via a binder application system with a pattern roller, characterized by the fact that the pattern roller has a cell pattern with a cell depth of $\leqq 15$ μm.

Finally, the object of the invention is a pattern roller with a cell pattern for implementing the above-mentioned method, characterized by the fact that the average cell depth is $\leqq 15$ μm.

In general, all solvent-free binder systems that are characterized according to their application properties as printing inks, paints or adhesives, for example, can be used for implementing the method according to the invention.

Preferred solvent-free printing inks are radiation-cured inks, with UV-cured inks based on acrylate, methacrylate or epoxy resin being preferred in particular. Such printing inks are commercially available under the designation UVAFLEX (Zeller & Gmelin GmbH, Eislingen), UVA-temp (Hostmann-Steinberg, Celle) or SUNCURE (Sun Chemical, Brussels).

Examples of suitable solvent-free adhesives include radiation-curable hot-melt adhesives based on acrylate, methacrylate or epoxy resin. These adhesives are used, for example, in the manufacture of compound foils.

The method according to the invention offers a number of advantages over known flexographic printing methods which use solvent-containing printing inks having a solvent content of 70 wt. %. Since traditional printing inks must release the solvent during the course of drying, complex changes such as shrinkage, porosity, pigment changes or "separation" of the binder inevitably occur. By comparison, solvent-free systems are considerably more stable during the period between application and curing. At present, only the shrink behavior of radiation-cured systems is known; in such systems, shrinkage during curing can be minimized by means of a suitable molecular weight distribution. Since the printing ink does not contain any solvent, it does not dry out, i.e. the thickness of the wet film is the same as the thickness of the dry film. Since solvent does not escape, there is no need for extraction measures or possible recovery of solvents, and solvent-free printing inks are largely without odor; both of these factors considerably improve occupational hygiene. Since no solvent evaporation occurs, special fire protection measures are also unnecessary, and, finally, the inks do not contain any raw materials banned by the German Federal Health Department or the Federal Drug Administration, which is important for printing food packaging. The Draize value is less than 1, which means that the skin irritation factor is equivalent to that of traditional inks containing solvents.

Due to the use of solvent-free printing inks consisting entirely of solids, the final print achieved is excellent. Optimum dots are produced, i.e. good dot gain conditions are observed when printing cylinder parameters such as the printing block material or substructure and, in particular, the pattern roller configuration are designed correctly. While printing inks containing solvents demonstrate a sharp increase in viscosity, as a result of solvent evaporation, the viscosity of printing inks or binders used according to the invention is stable, and the viscosity can be controlled within a defined range by means of temperature. In contrast to printing inks containing solvents, the ink does not dry out in the machine, even during a long period of standstill such as over the weekend. When using UV-cured systems, care must naturally be taken to ensure that protection against all possible effects of UV radiation is provided.

The solvent-free binder systems used according to the invention, e.g. printing inks or hotmelt adhesives, can be processed at room temperature, i.e. at 20°–25° C. However, this can easily produce problems due to an excessively high binder viscosity, and certain binders cannot be processed at all at room temperature under practical conditions. For this reason, the binder should be processed at temperatures that are 5°–60° C. higher than the processing temperatures of common solvent-containing printing inks. In relation to the room temperature indicated above, this means a processing range of 25°–85° C., preferably 30°–65° C. Temperatures of 35°–45° C. are preferred in particular, and temperatures of approximately 40° C. have proven to be successful in practice.

Depending on the operating temperature selected, it is necessary to control the temperature over the entire application system of an applicator device, e.g. a printing device, in order to ensure uniform printing; if necessary, the impression cylinder and high-pressure rollers must be heated as well.

In general, binder systems with viscosities of 0.01–2 Pa s (at shearing speeds of 25–400 $s^{-1}$) can be processed. At the preferred temperatures of around 40° C. for printing inks, the ink viscosities are in the general range of 0.02–0.5, preferably 0.05–0.15, with 0.08–0.12 being preferred in particular. In the case of printing inks, the pigment content is generally 20–50 wt. %. In the case of adhesives, the processing temperatures and the viscosities are generally higher.

A particular advantage of radiation-curable binder systems lies in the fact that they do not need to be dried (due to the lack of solvents) and also that curing (cross-linking) of the binder takes place so quickly that multicolor, multilayer printing can be carried out without problems. In this regard, difficulties can sometimes arise in known methods that use systems containing solvents because the ink can smear as a result of incomplete drying and/or incomplete cross-linking.

Cylinders, printing blocks, cleaning rags, dirty clothing, etc. can be cleaned, for example, with aqueous, alkaline solutions containing surfactants or even with solvents. Moreover, the UV-cured inks demonstrate an excellent degree of resistance to effects such as chemicals, temperature, scratching, creasing and adhesion.

Overall, printing with the method according to the invention results in many fewer problems than the known methods that use systems containing solvents. UV-curable printing inks are considerably more expensive than the known inks containing solvents. With respect to the solids content or quantity of printed products, however, this comparison is independent of cost, and the use of solvent-free printing inks also produces the above-mentioned advantages.

The method according to the invention can be used to print numerous materials, such as materials made of polyethylene, polypropylene, polyamides, polyesters, paper or steel/aluminum (both painted and unpainted) with a high degree of adhesion and color fastness. In this regard, a variety of ink systems must often be used with traditional inks. UV-curable inks have a particular advantage with regard to printed synthetic webs, since they can be sealed and laminated without discoloration. Finally, a further advantage lies in the fact that, when UV-cured printing inks are used, the UV radiation sterilizes the printed material (possibly even from the inside), which offers advantages for medical applications.

In a further particular embodiment of the method according to the invention, a radiation-curable laminating adhesive is used as the solvent-free binder system and is applied to an initial web material; a second web material is then added and laminated. Depending on the adhesive system, a reaction (curing) induced by radiation (UV light or electron beams) can be used both before and after lamination. An advantage of this method lies in the fact that the adhesive is cured directly after lamination so that the roll of compound material can be cut immediately, while curing takes 3–10 days with methods according to the current state of the art.

In a further embodiment of the method according to the invention, the adhesive is applied only in the printed region, which means that adhesive-free bits of foil can be used after the printed regions are punched out. An important application for this process is the recovery of compound foil waste, e.g. pressed screen recycling.

The method according to the invention should be carried out with an applicator device having an impression cylinder and one or more application rollers, each of which is supplied with the binder system, preferably printing ink, via a binder application system having a pattern roller, with the cell pattern of the pattern roller having a cell depth of $\leqq 15$ μm, which is considerably less than that of the common pattern rollers (40 μm). A cell depth in the range of 1–10 μm is preferred, with a range of 5–8 μm being preferred in particular. The cell geometry can be the same as that used for known pattern rollers with a greater cell depth. The cells should be designed geometrically in the form of cylinders, domes or truncated pyramids. In addition, cell geometries which allow a great deal of the ink to remain in the cell after application have proven to be particularly advantageous, i.e. emptying of the cell is reduced during printing.

An important parameter for pattern rollers is the so-called pattern width (L/cm), which indicates the number of cells, measured along a 1 cm line. A pattern width of 100 L/cm (a common pattern width for traditional pattern rollers) means, for example, that there are 100 cells per cm or 10,000 cells per $cm^2$. The pattern rollers according to the invention have considerably greater pattern widths, generally in the range of 170–280, preferably 180–240 and particularly 190–200 L/cm, where a pattern width of 200 L/cm corresponds to 40,000 cells/$cm^2$.

Another pattern roller parameter that is important for practical application is the cell-cell wall ratio (C/W ratio), which, as in the case of the pattern width, is measured along a line (see FIG. 2). According to the invention, the C/W ratios are 8:1–1:1, preferably 5:1–2:1 and particularly 3:1–2:1. One effect of the linear measurement used for the C/W ratio is that, when the same C/W ratio is applied, the wall area in relation to the area of the cell openings is greater with round cells than it is with square cells. This difference would have to be taken into account, since printing and laminating always take place in terms of area.

In a special embodiment of the pattern, the wall regions are designed with indentations; however, these indentations are not as deep as the cells, e.g. they are only 5 μm deep with a cell depth of 10 μm. In relation to the overall wall area, the indentations in the wall regions should be just deep enough to still provide a sufficient supporting surface for the doctor blade; otherwise the pattern roller cannot be successfully supplied with printing ink or binder. The indentations in the wall regions offers an advantage for full-area printing, since the improved coverage of this process results in better shading and thus higher-quality printed products.

In a particular embodiment of the applicator device, one or more devices for emitting high-energy radiation onto the printed web material are attached to the outer circumference of the impression cylinder. These radiation devices should be designed as UV radiators. Due to the high energy density of the UV radiators (approximately 150 W/cm), the radiators should be water cooled, and a water-cooled housing has proven to be particularly successful. In another preferred embodiment, movable, water-cooled reflectors are installed inside the housing; these reflectors automatically move between the radiation source and the impression cylinder in the event of a malfunction, particularly during standstills, thereby preventing the printed material and system components from overheating. At the same time, the radiator output is reduced to a minimum, e.g. approximately 40 W/cm. The radiator output is continuously adjusted when changes occur in the throughput speed of the printed material.

In another particular embodiment, the application system has a chamber-type doctor blade with a binder level control for supplying the pattern roller with binder system or printing ink; the chamber-type doctor blade is loaded and emptied by a binder container that is connected to the doctor blade via a two-way pump and a single line. The line should empty into the chamber-type doctor blade at the lowest point in the binder contents, thereby ensuring that fresh binder is supplied from below.

In another preferred embodiment, the chamber-type doctor blade is designed as a heatable doctor blade with elastic sealing profiles mounted on both sides as well as feeder and discharge lines. In contrast to printing inks containing solvents, the viscosity of solvent-free inks cannot be controlled by means of the solvent content. A desired reduction in viscosity can therefore be accomplished only by increasing the temperature. The heatable chamber-type doctor blade is used to reach a higher temperature and to maintain the desired temperature value at a constant level. The doctor blade arms can be adjusted and fixed in place, for example, by means of steel springs. The side-mounted sealing profiles should be made of an elastomer material such as non-swelling rubber. The chamber-type doctor blade can be easily cleaned by removing the side-mounted sealing profiles.

In another particular embodiment, the chamber-type doctor blade contains one or more additional sealing profiles at a distance from the side-mounted sealing profiles, and the chambers formed by these profiles have a separate ink feeder line and a level control. This makes it possible to supply the individual chambers with different inks, so that printing can be carried out with several colors at the same time.

In another particular embodiment, and in accordance with Patent Application P 41 08 883.2, the impression cylinder and/or the binder a device according to the invention is divided into several thermal zones in an axial direction which have temperature control devices that can be set individually. When solvent-free binder whose viscosity depends on the temperature is used, this embodiment allows the amount of solvent or ink applied to be changed or measured selectively.

In another particular embodiment, the printed material is subjected to a corona treatment in accordance with Patent Application P 39 35 013, with the corona electrodes being heated beyond their operating position to an operating temperature at which they operate ozone-free and then returned to their operating position. This high-temperature electrode technology can also be applied only if solvent-free binder systems are used (to protect against explosions).

The pattern roller according to the invention consists, for example, of steel and has a surface made of ceramic or titanium nitride. Laser beams can be used for engraving (generation of the pattern geometry).

The invention is described below on the basis of the drawings:

FIGS. 2A–2E show considerably enlarged partial illustrations (II is a pattern roller 13 in FIG. 1) of various surface structures on a pattern roller according to the invention.

Figure 1:
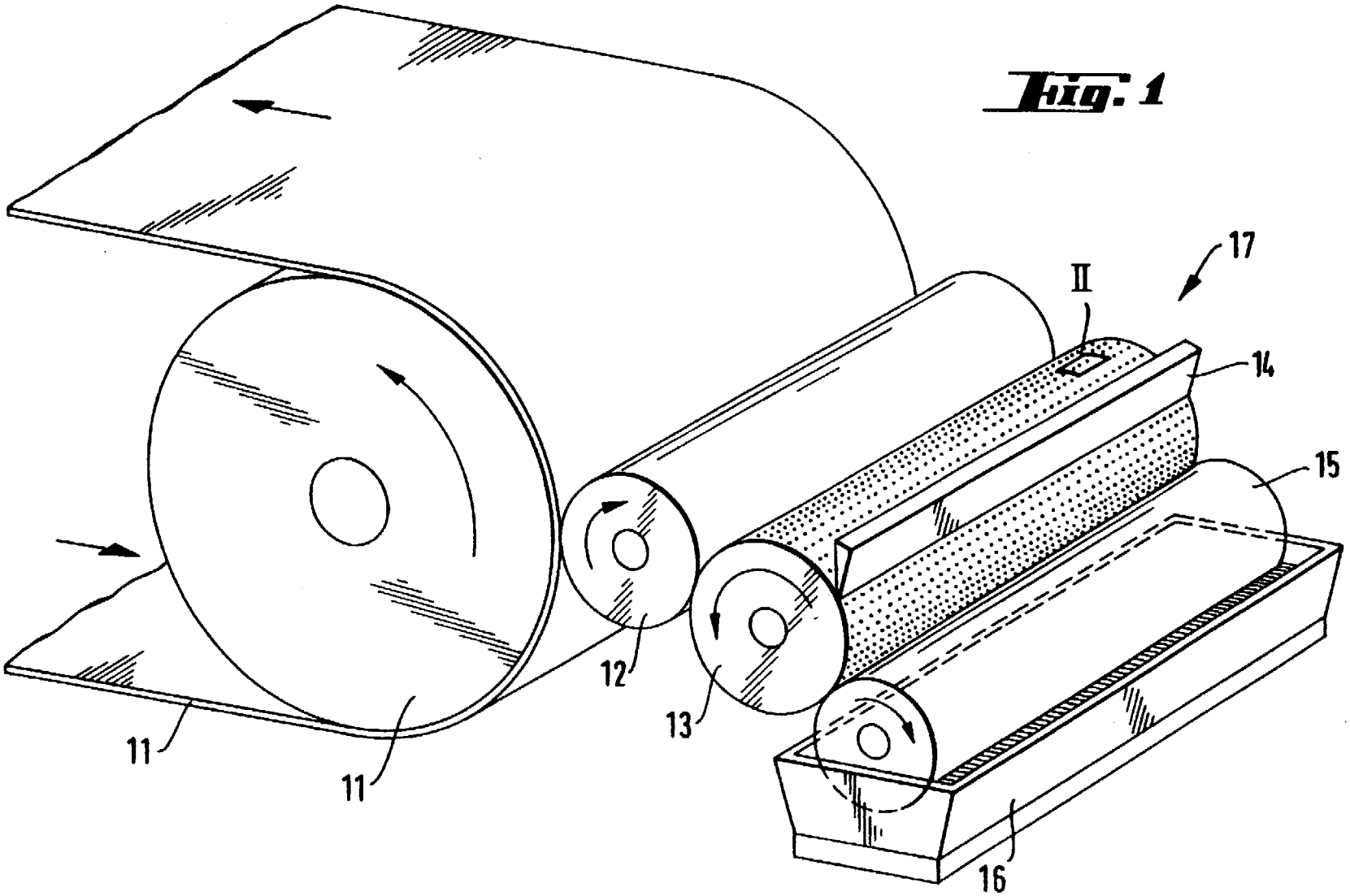
FIG. 1 shows an illustration in perspective of an applicator device according to the invention.

In the applicator device shown in FIG. 1, a web material (polyethylene foil with a thickness of 20 μm) is passed around an impression cylinder (11) at a speed of 300 m/min. and is printed with a high-pressure roller (12). The high-pressure roller (12) is supplied via an inking system (17), consisting of a pattern roller (13) with a doctor blade (14) as well as an inking roller (15) with an ink trough (16). The pattern roller (13) has a cell depth (t) of 6±1 μm (see FIG. 2). The pattern roller (13) has the geometry illustrated in FIG. 2A with a pattern width of 180 L/cm, which corresponds to 32,400 cells/cm$^2$, and a C/W ratio of approximately 2:1. A solvent-free UV-curable acrylate ink (consisting entirely of solids) with a pigment content of 20 wt. % is used. This ink has a viscosity of 0.1 Pa s at a temperature of 40° C. The high-pressure roller (12) is a common letterpress printing block. Printing is carried out with an application thickness of 1.5 μm, with practically no different existing between the thickness of the wet and dry film. Directly after the ink is applied to the web material (10) by means of the high-pressure roller (12), the ink is cured by two UV radiators attached to the outer circumference of the impression cylinder (11) (see FIG. 6 for a detailed description).

Figure 2E:
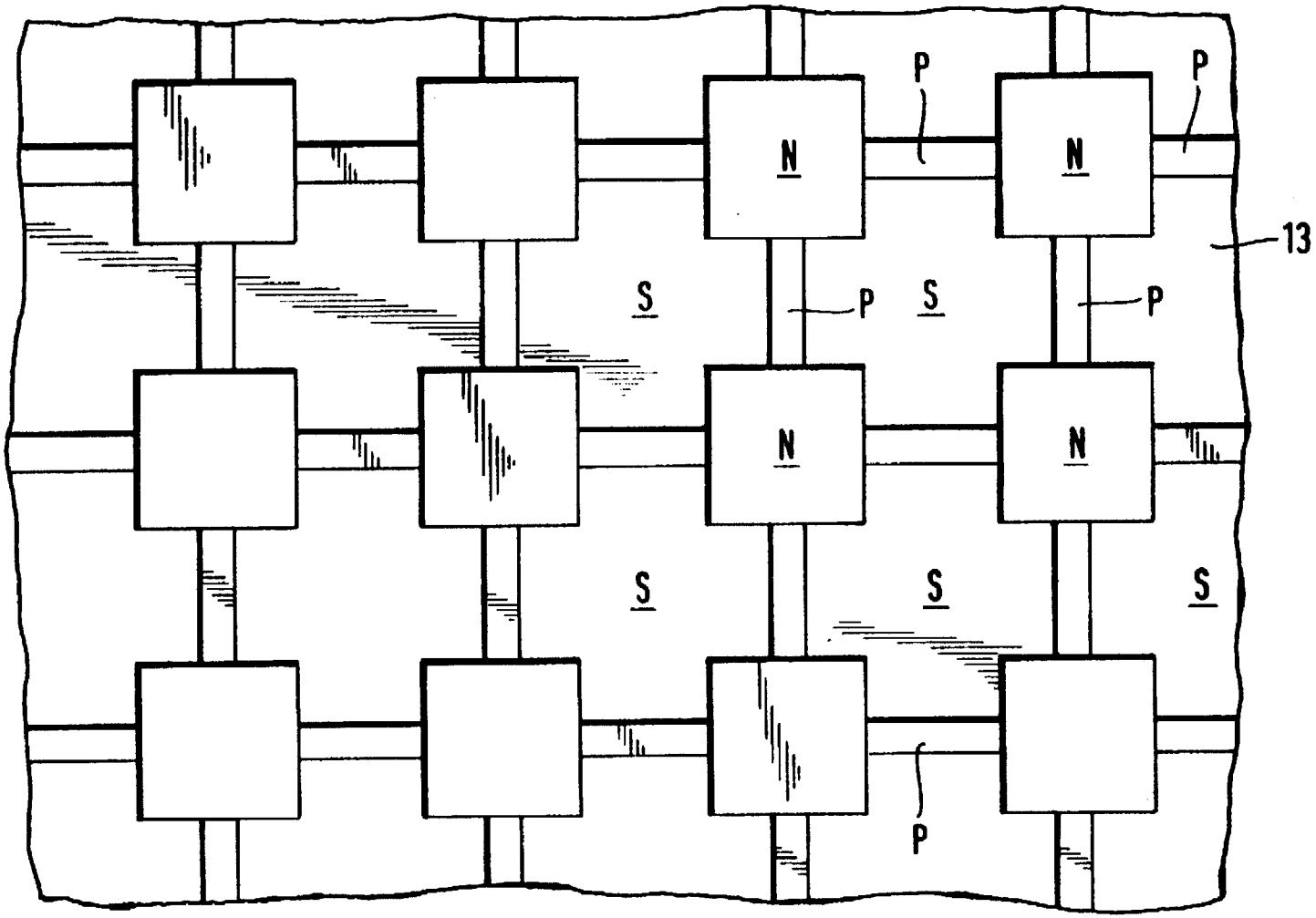

FIG. 2 shows the details of the surface quality of the pattern roller (13); FIGS. 2A, 2B, 2C and 2D illustrate the cell geometries in the order given in the form of domes, truncated pyramids, full pyramids and cylinders, with the cell-cell wall ratio ranging from approximately 2:1 (FIG. 2A) to approximately 3:1 (FIG. 2D). FIG. 2E shows a variant of FIG. 2B (viewed from above) with wall indentations. With a depth (t) of the cells (N) amounting to 10 μm, the wall regions (S) contain indentations (P) amounting to 5 μm; as a result, the cells (N) are interconnected by the indentations (P), while a sufficient amount of wall area (S) is still provided for supporting the doctor blade. In the embodiment shown in FIG. 2E, improved coverage, and thus better shading, can be achieved for full-area printing, thereby increasing print quality.

Figure 3:
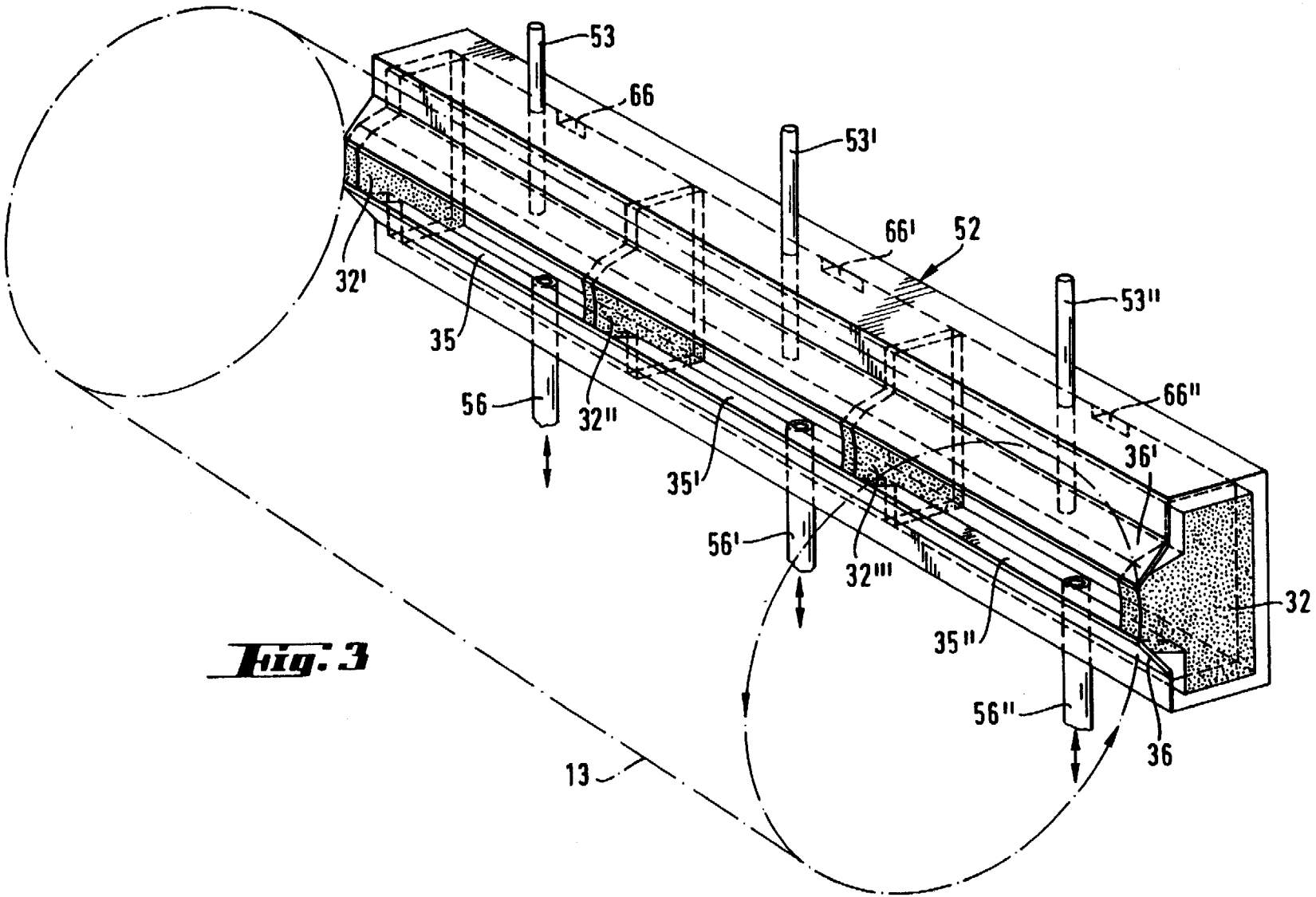
FIG. 3 shows an illustration in perspective of a heatable chamber-type doctor blade.

FIG. 3 shows an illustration in perspective of a heatable chamber-type doctor blade (52) which is closed off on both ends by elastic sealing profiles (32), (32'). By means of additional sealing profiles (32"), (32"') installed inside the chamber-type doctor blade (52), the latter is divided into three separate chambers (35), (35'), (35"), each of which has a separate ink feed line (56), (56'), (56") and a separate ink level control (53), (53'), (53"). By dividing the chamber-type doctor blade, it is possible to supply the separate chambers with different inks, thereby allowing printing to be carried out with several colors at the same time. By supplying different temperatures in an axial direction, using temperature control devices that can be set individually (not shown), the viscosity of the individual inks can be influenced, thereby making it possible to selectively change or measure the amounts of ink applied. Doctor blade arms (36), (36') are adjusted and fixed in place by means of steel springs (not shown). The side-mounted and internal sealing profiles are made of non-swelling rubber. The chamber-type doctor blade can be easily cleaned by removing the side mounted sealing profiles (32), (32') or moving the center sealing profiles (32"), (32"').

Figure 4:
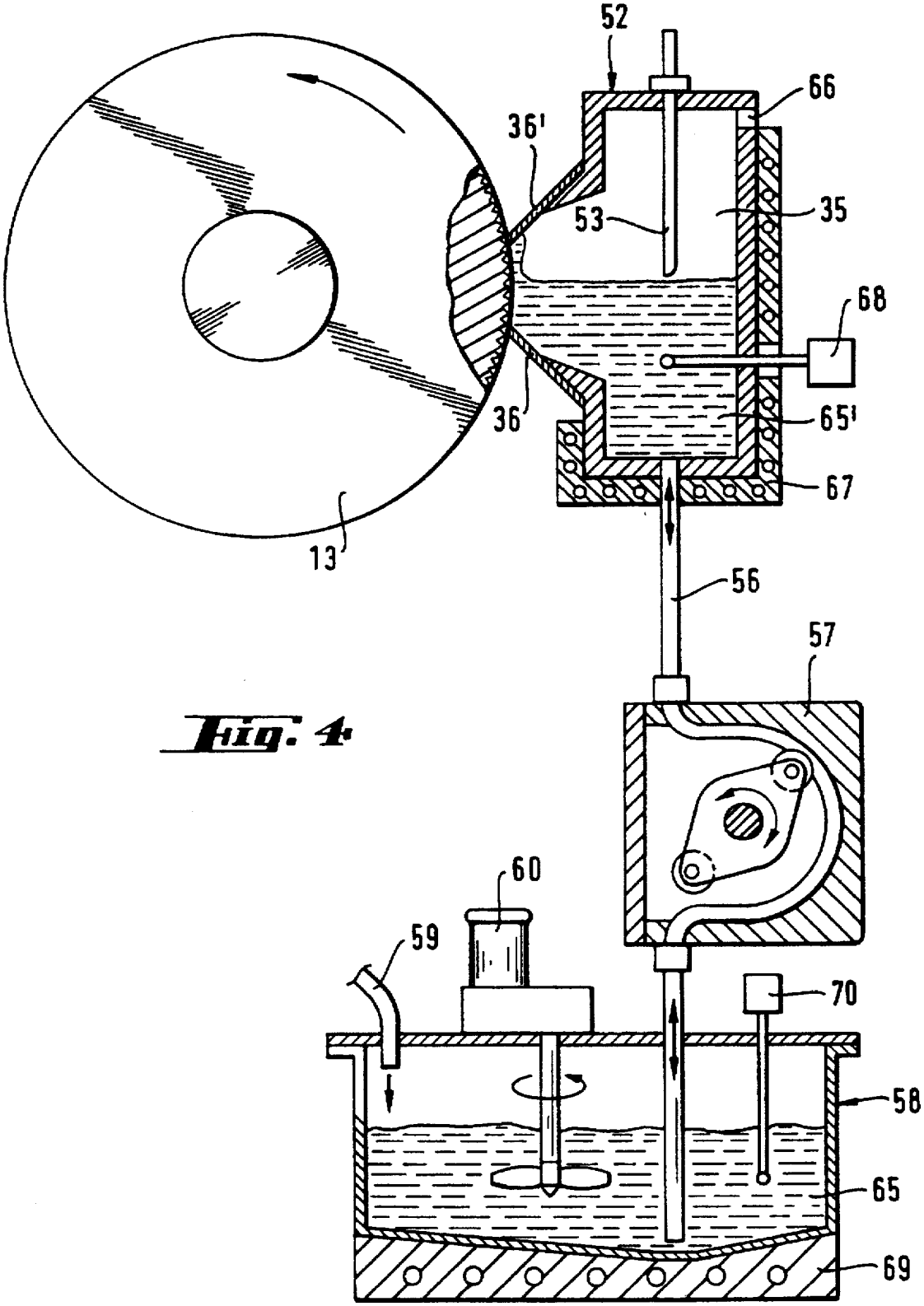
FIG. 4 shows a cross-section of a chamber-type doctor blade with ink container and pump.

FIG. 4 shown as cross section of the chamber-type doctor blade (52) illustrated in FIG. 3; it is supplied via an ink container (58) which is connected to the doctor blade (52) via a two-way pump (57) and a single ink line (56). The ink line (56) empties into the chamber-type doctor blade (52) at the lowest point in the ink contents, so that fresh ink is always supplied from below. The ink container (58) is supplied via a feeder line (59). An agitator (60) maintains the homogeneity or the ink (65). The chamber-type doctor blade (52) has venting devices (66) in order to prevent bubbles from forming in the ink contents (65'). Both the ink container (58) and the chamber-type doctor blade (52) can be heated by means of temperature control devices (69) and (67), respectively, with the temperature being maintained at a constant level by means of control devices (70) and (68), respectively.

Figure 5:
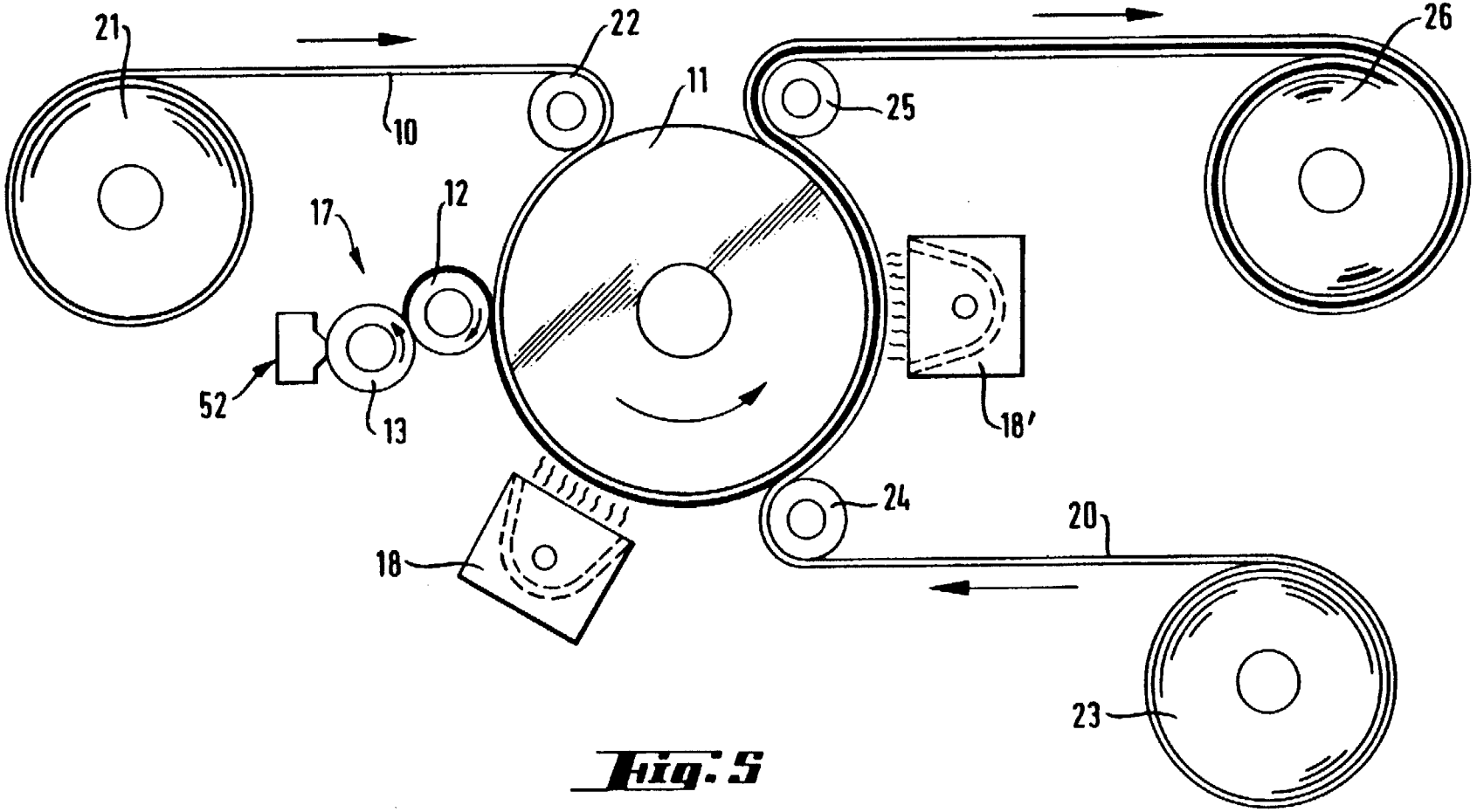
FIG. 5 shows a schematic illustration of an applicator device in conjunction with a laminating device.

FIG. 5 shows a schematic diagram of an applicator device according to the invention in conjunction with a laminating device. A web material (10) (polyethylene, 20 μm) is removed from a roll (21) and supplied to an impression cylinder (11) via a reversing roller (22). A UV-curable laminating adhesive is applied to the web material (10) with a high-pressure roller (12). The high-pressure roller (12) is supplied with laminating adhesive by means of a pattern roller (13) with a heatable chamber-type doctor blade (52). Another web material (20) (polyamide, 60 μm) is then placed on top of the web material coated with the reactive laminating adhesive (10); this second web material (20) is removed from a roll (23) and placed on the adhesive-coated web material (10) by means of a laminating roller (24). The laminated compound material is then placed on a roll (26) after passing over a reversing roller (25). UV radiators (18), (18') for curing the reactive laminating adhesive are attached to the outer circumference of the impression cylinder (11). Before the second web of material (20) is applied, the reactive adhesive is pre-cured by the UV radiator (18), with care being taken to ensure that an adequate degree of tackiness is available for applying the second web material (20), thereby ensuring a strong lamination bond. After the second web material (20) is applied, the adhesive is re-cured with the UV radiator (18'). The web speed of the impression roller (11) is 150 m/min. A solvent-free, UV-curable laminating adhesive based on epoxy resin with a viscosity of 0.6 Pa s at an operating temperature of 60° C. is used. The adhesive is applied all over in a volume of 3 g/m$^2$, which corresponds to an application thickness of approximately 3 μm. A pattern roller (13) with the geometry illustrated in FIG. 2E and having a pattern width of 170 and a C/W ratio of 3:1 is used (the wall depressions are calculated as wall). The entire system is maintained at an operating temperature of 60° C. by means of appropriate temperature control devices.

Figure 6:
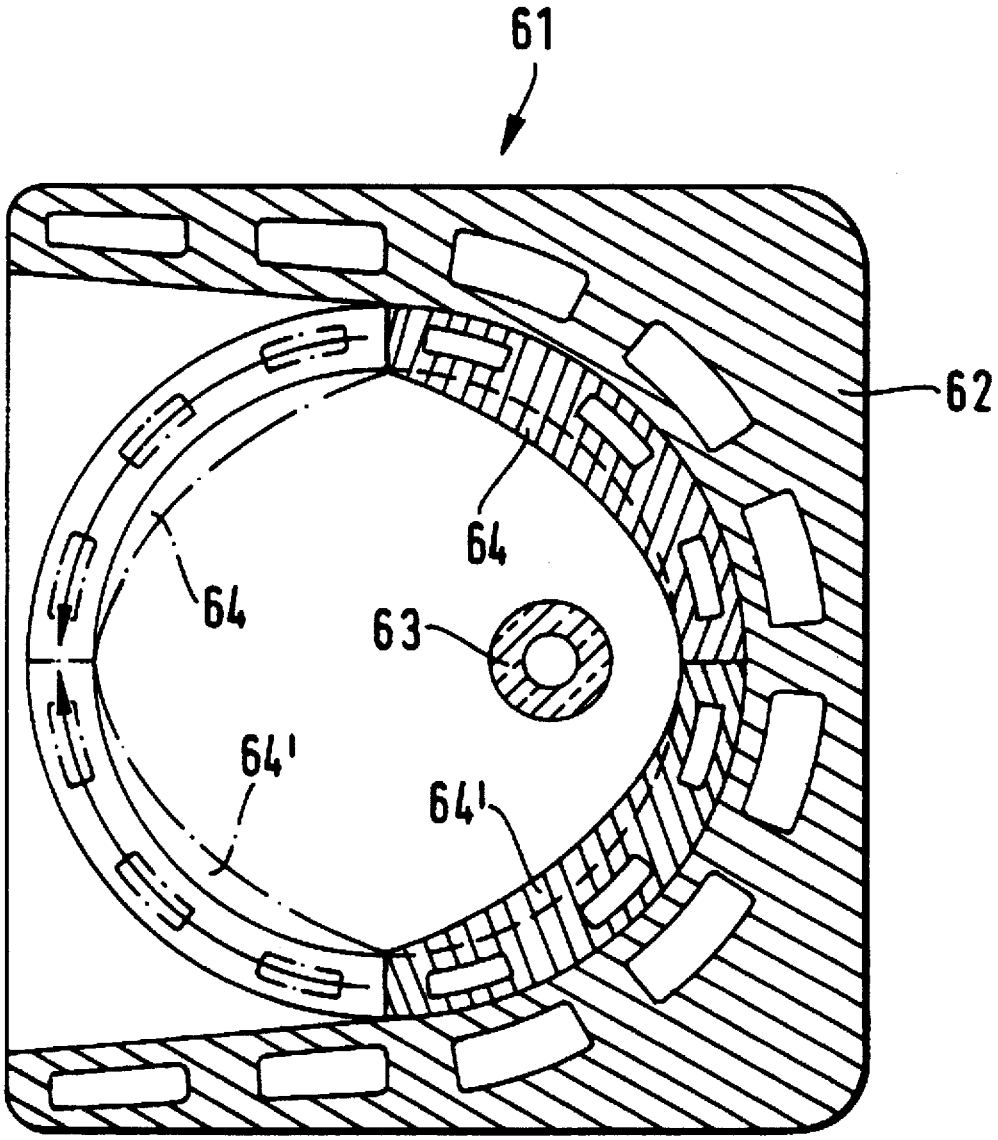
FIG. 6 shows a cross-section of a UV radiator with movable reflectors.

FIG. 6 shows the details of this type of UV radiator. This type of UV radiator (61) has a UV radiation source (63) with an energy density of 150 W/cm (in an axial direction) which is installed in a water-cooled housing (62). Movable reflectors (64), (64'), which are also water-cooled, are installed inside the housing; these reflectors automatically move between the radiation source (63) and the impression cylinder (11) in the event of malfunctions, in particular when the system comes to a standstill (see FIG. 5), thereby preventing the web material (10), or (10) and (20) from overheating (see FIG. 5). In addition, a control device is provided (not shown) which automatically adjusts the radiation power when changes occur in the web speed of the impression cylinder (11).

We claim:

1. A method for applying a binder system to web material using a letterpress printing process which comprises applying the binder system to the letterpress form of an application roller by means of a pattern roller applying a solvent-free binder system by means of a pattern roller having a cell pattern with a cell depth ≦15 μm, wherein the improvement comprises:

a radiation-curable printing ink being used as the solvent-free binder system; or a radiation-curable laminating adhesive being used as the solvent-free binder system a second web of material being laminated onto the web material coated with the adhesive and the adhesive being radiation-cured before and/or after the lamination.

2. The method according to claim 1, wherein a UV-curable printing ink is used as the solvent-free binder system.

3. The method according to claim 2, wherein an acrylate- or methacrylate-based printing ink is used as the solvent-free binder system.

4. The method according to claim 3, wherein a printing ink with a pigment content of 20 to 50 wt. % and a viscosity of 0.08 to 0.12 Pa s at a temperature of about 40° C. is used as the solvent-free binder system, and said ink is processed at a temperature of 40°–60° C.

5. An applicator device comprising an impression cylinder (11), at least one application roller (12) and a binder application system (17) which supplies each application roller with a binder system, said binder application system (17) being equipped with a pattern roller (13) having a cell pattern with a depth (t) of ≦15 μm, wherein the improvement comprises the binder application system (17) including a chamber-type doctor blade (52) for supplying a pattern roller (13) with the binder system, said chamber-type doctor blade (52) having a binder level control (53) which is emptied by a container (58) connected to said chamber-type doctor blade (52) via two-way pump (57) and a single binder line (56).

6. The applicator device according to claim 5, wherein the cell depth (t) of the pattern roller (13) is 1–10 μm.

7. The applicator device according to claim 6, wherein the cell depth (t) of the pattern roller (13) is 5–8 μm.

8. The applicator device according to claim 5, wherein the pattern roller (13) has a cell-cell wall ratio of 3:1 to 2:1.

9. The applicator device according to claim 5, wherein the pattern width of the pattern roller (13) is 180–240 L/cm.

10. The applicator device according to claim 5, wherein at least one device (18) for emitting high-energy radiation onto a web material (10) is mounted in close proximity to the outer circumference of the impression roller (11).

11. The applicator device according to claim 10, wherein each said the device (18) is designed as a UV radiator (61).

12. The applicator device according to claim 11, wherein each said UV radiator (61) is cooled.

13. The applicator device according to claim 12, wherein each said UV radiator (61) is equipped with a water-cooled housing (62) and movable, water-cooled reflectors (64, 64').

14. The applicator device according to claim 5, wherein the chamber-type doctor blade (52) includes a chamber for holding the binder system, and the binder line (56) opens into the chamber-type doctor blade (52) at the lowest point in the chamber.

15. The applicator device according to claim 5, wherein the chamber-type doctor blade is designed as a heatable doctor blade with elastic sealing profiles (32, 32') on both sides as well as feeder lines and discharge lines (56).

16. The applicator device according to claim 15, wherein the chamber-type doctor blade (52) has at least one additional sealing profile (32", 32'") at a distance from the side-mounted sealing profiles (32, 32'), and each of the chambers formed by these profiles (35, 35', 35") has as separate binder feeder line (56, 56', 56") and a separate level control (53, 53', 53").

17. The applicator device according to any of claims 5 or 14 through 16, wherein the chamber-type doctor blade (52) has venting devices (66, 66', 66") for preventing bubbles from forming in the binder system.

18. An applicator device comprising an impression cylinder (11), at least one application roller (12) and a binder application system (17) which supplies each application roller with a binder system, said binder application system (17) being equipped with a pattern roller (13) having a cell pattern with a depth (t) of 1 to 10 μm.

19. A method for applying a binder system to web material using a letterpress printing process which comprises applying the binder system to the letterpress form of an application roller by means of a pattern roller, and applying a solvent-free binder system by means of a pattern roller having a cell pattern with a cell depth of ≦15 μm, wherein the solvent-free binder system is:

a printing ink with a pigment content of 20 to 50 wt. % and a viscosity of 0.08 to 0.12 Pa s at a temperature of about 40° C., wherein the printing ink is processed at a temperature of 40°–60° C.; or a radiation-curable laminating adhesive, wherein a second web of material is laminated onto the web material coated with the adhesive, and the adhesive is radiation-cured before and/or after lamination.

* * * * *